US006997608B2

(12) United States Patent
Sisto et al.

(10) Patent No.: US 6,997,608 B2
(45) Date of Patent: Feb. 14, 2006

(54) ROTATABLE BUCKY WITH DETENT

(75) Inventors: Eugene Sisto, Rochester, NY (US); Friedrich Ueffinger, Rochester, NY (US); James W. Sekol, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/942,188

(22) Filed: Sep. 16, 2004

(65) Prior Publication Data

US 2005/0074096 A1 Apr. 7, 2005

Related U.S. Application Data

(60) Provisional application No. 60/504,775, filed on Sep. 18, 2003.

(51) Int. Cl.
*H01J 31/50* (2006.01)

(52) U.S. Cl. ..... 378/189; 378/167

(58) Field of Classification Search ..... 378/167, 378/181, 189

See application file for complete search history.

(56) References Cited

U.S. PATENT DOCUMENTS 3,891,856 A * 6/1975 Amor et al. ..... 378/197
4,300,053 A * 11/1981 Guynes ..... 378/181
4,659,048 A 4/1987 Fahrion
5,103,472 A 4/1992 Takagi
5,317,617 A * 5/1994 Lange ..... 378/189
6,113,265 A 9/2000 Babler
RE37,614 E 4/2002 Ohlson
2001/0040939 A1 11/2001 Kobayashi
2002/0080921 A1 * 6/2002 Smith et al. ..... 378/189

* cited by examiner

*Primary Examiner*—Edward J. Glick
*Assistant Examiner*—Chih-Cheng Glen Kao
(74) *Attorney, Agent, or Firm*—Susan L. Paralski

(57) ABSTRACT

An apparatus for rotating a bucky about an axis between a first and second position. The apparatus includes a base member stationarily disposed on the bucky and having a first and second rotational position; a first and second absorption member; and a first and second assembly. The first assembly is disposed at the first position and is slidably mounted relative to the base member. It includes a first detent adapted to receive a roller when the bucky is in the first position. The first assembly is disposed intermediate the first absorption member and base member such that the first absorption member biases the first assembly toward the base member. The second assembly is disposed at the second position and is slidably mounted relative to the base member. It includes a second detent adapted to receive a roller when the bucky is in the second position. The second assembly is disposed intermediate the second absorption member and base member such that the second absorption member biases the second assembly toward the base member.

5 Claims, 6 Drawing Sheets

ROTATABLE BUCKY WITH DETENT

CROSS REFERENCE TO RELATED APPLICATIONS

This is a 111A application of Provisional Application Ser. No. 60/504,775 filed on Sep. 18, 2003, which is incorporated herein by reference.

FIELD OF THE INVENTION

The invention is directed to an assembly for rotating a member between a first and second position. More particularly, the invention relates generally to the field of x-ray imaging and in particular to a bucky which is rotatable.

BACKGROUND OF THE INVENTION

X-ray/radiographic imaging units are well known for medical diagnosis. Various methods are known for obtaining a radiographic image on an image receiver. Three well known methods are described below.

A first method employs an image receiver of a conventional photosensitive sheet of film. The film is disposed within a light-tight cassette and imaged. Once imaged, the sheet of film is chemically processed to transform the latent image into an analog x-ray image.

A second method uses a stimulable storage phosphor sheet as the image receiver. This method is generally known as computed radiography (CR).

A third method, often referred to as direct radiography (DR), uses a radiation image detector as the image receiver. The detector is capable of detecting the radiation image on real-time basis and directly outputting a digital signal. More particularly, an x-ray source projects an x-ray beam through an object (such as a body part of an individual) to produce an x-ray image captured by a detecting member. The detector can rely on direct conversion of x-rays to charge carriers or alternatively indirect conversion in which x-rays are converted to light which is then converted to charge carriers and charge readout. The detector is typically formed as a flat panel.

A bucky is a well known structure/member which can be employed to support/house the image receiver during the imaging process. For example, in the third method (i.e., DR), the detector is typically mounted in a bucky. The bucky can also house other elements, for example, an anti-scatter grid which is commonly used to prevent scattered radiation from affecting the final x-ray image. Such anti-scatter grids are typically employed when the object to be imaged is relatively thick (for example, a human chest).

The bucky can be mounted in various configurations, for example, on an x-ray table or on a radiographic stand. FIG. 1 shows a bucky 10 mounted on a radiographic stand.

In the medical practice, it is often desirable to obtain a radiographic image of the subject from various directions or in a plurality of ways, for example, horizontal and vertical. Accordingly, there is a need to rotate the bucky between various directions/orientations/ways. For example, when the bucky is used on a radiographic stand, it is desirable to rotate/pivot/move the bucky to various directions/orientations/ways to obtain the desired radiographic images. As shown in FIG. 1, bucky 10 can rotate about an axis substantially perpendicular to a radiographic stand 12. If the bucky is of varying dimension in its width and length, then it may be desirable to rotate the bucky between a plurality of positions, for example, a "portrait" orientation and a "landscape" orientation. Bucky 10 is shown in a portrait orientation in FIG. 2A wherein the height dimension (the dimension directed along the stand) is greater than the width dimension (the dimension perpendicular to the vertical stand). Bucky 10 is shown in a landscape orientation in FIG. 2B wherein the width dimension is greater than the height dimension.

Apparatus are known for rotating x-ray imaging units, for example, U.S. Pat. No. 5,103,472 (Takagi), US RE 37,614 (Ohlson), U.S. Pat. No. 6,113,265 (Babler), U.S. Pat. No. 4,659,048 (Ohlson), and U.S. Pat. Application Publication No. 2001/0040939 (Kobayashi).

While such apparatus may have achieved certain degrees of success in their particular applications, there exists a need for an apparatus/assembly for rotating a bucky wherein the apparatus is durable, readily manufacturable, allows rotation of a bucky without undue effort/force by a health professional, and secures the bucky in each rotated position.

SUMMARY OF THE INVENTION

An object of the present invention is to provide an apparatus for rotating a bucky between a plurality of positions.

A further object of the present invention is to provide such an apparatus which is durable, readily manufacturable, allows rotation of a bucky without undue effort/force by a health professional, and secures the bucky in each rotated position.

These objects are given only by way of illustrative example, and such objects may be exemplary of one or more embodiments of the invention. Other desirable objectives and advantages inherently achieved by the disclosed invention may occur or become apparent to those skilled in the art. The invention is defined by the appended claims.

According to one aspect of the invention, there is provided an apparatus for rotating a bucky about an axis between a first and second position. The apparatus includes (1) a base member stationarily disposed on the bucky and having a first and second rotational position, (2) a first and second absorption member, and (3) a first and second assembly. The first assembly is disposed at the first position and is slidably mounted relative to the base member. It includes a first detent adapted to receive a roller when the bucky is in the first position. The first assembly is disposed intermediate the first absorption member and base member such that the first absorption member biases the first assembly toward the base member. The second assembly is disposed at the second position and is slidably mounted relative to the base member. It includes a second detent adapted to receive a roller when the bucky is in the second position. The second assembly is disposed intermediate the second absorption member and base member such that the second absorption member biases the second assembly toward the base member.

BRIEF DESCRIPTION OF THE DRAWINGS

The foregoing and other objects, features, and advantages of the invention will be apparent from the following more particular description of the embodiments of the invention, as illustrated in the accompanying drawings. The elements of the drawings are not necessarily to scale relative to each other.

DETAILED DESCRIPTION OF THE INVENTION

Figure 1:
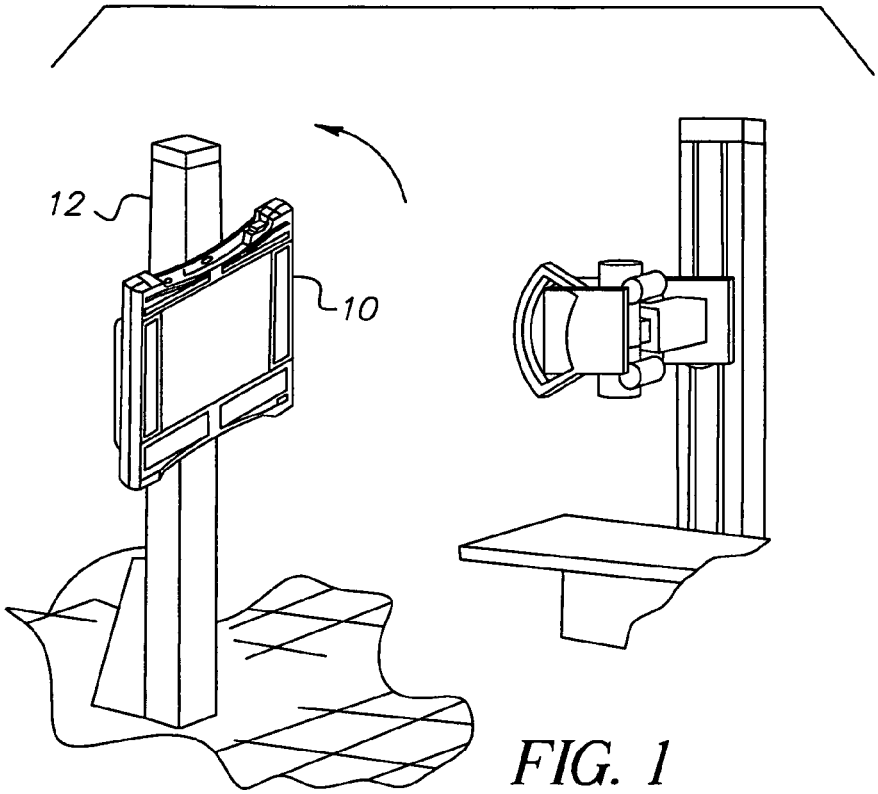
FIG. 1 shows a bucky mounted on a radiographic stand.
Figure 2A:
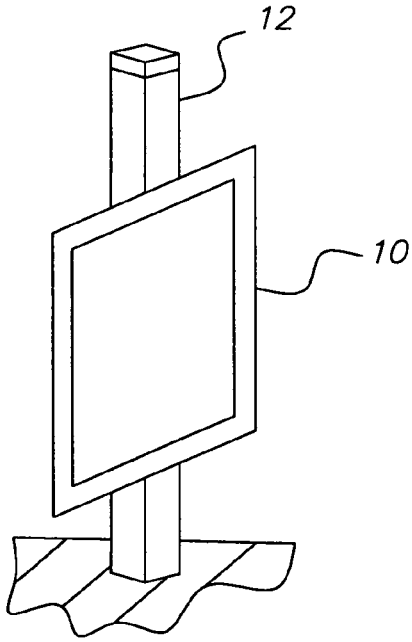
FIG. 2A shows the bucky of FIG. 1 positioned in a portrait orientation.
Figure 2B:
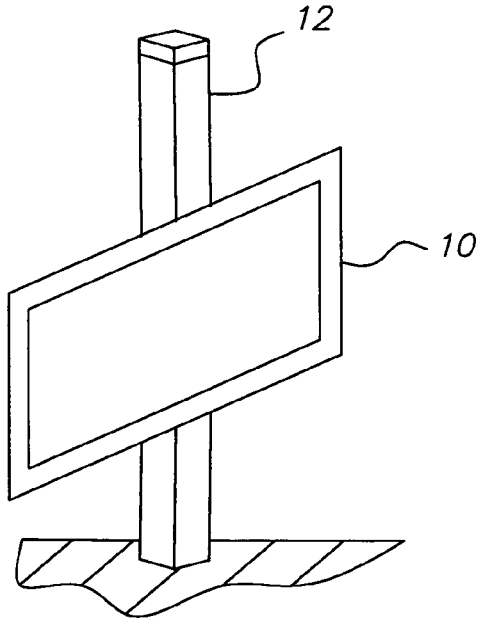
FIG. 2B shows the bucky of FIG. 1 positioned in a landscape orientation.

The following is a detailed description of the preferred embodiments of the invention, reference being made to the drawings in which the same reference numerals identify the same elements of structure in each of the several figures.

As indicated above, it is desirable to rotate the image receiver in a plurality of orientations. As such, if the image receiver is disposed/supported by a bucky, then it is desirable to rotate the bucky in a plurality of orientations/positions.

The present invention is directed to an assembly which provides for the manual (not motor, gravity or spring load driven) rotational movement of a member between a first and second position.

For Applicant's particular application, the member is bucky 10. Those skilled in the art will recognize that the member can be other elements, for example, the detection member of a DR system or an x-ray source.

The assembly of the present invention is intended to be reliable, durable, manually actuatable, provide for secure and safe positioning at its positions, protected from accidental actuation, and not require activation by the pressing of a "push button" or other activation member.

It is noted that the number of positions can be greater than two and the angular differential can be of any value, for ease of discussion for presenting the present invention, the apparatus of the present invention will be discussed with regard to two positions which are spaced by 90 degrees.

Generally, the assembly is comprised of a cam segment/portion, two detent inserts, and two energy absorbing members. More particularly, the assembly of the present invention is a spring-loaded roller operating in a cam segment wherein the spring-loaded roller engages detents at each end of the cam segment. In a preferred embodiment, the detents are located at 90 degrees along the cam segment. For example, the detent positions can be located such that they positively locate the roller at positions corresponding to portrait and landscape. In operation, to move between the positions, bucky 10 is rotated with sufficient force to overcome the detent ramp angles. Bucky 10 continues to rotate until it stops in the indented position detent. The detents provide energy absorption sufficient to prevent bucky 10 component damage.

Figure 3:
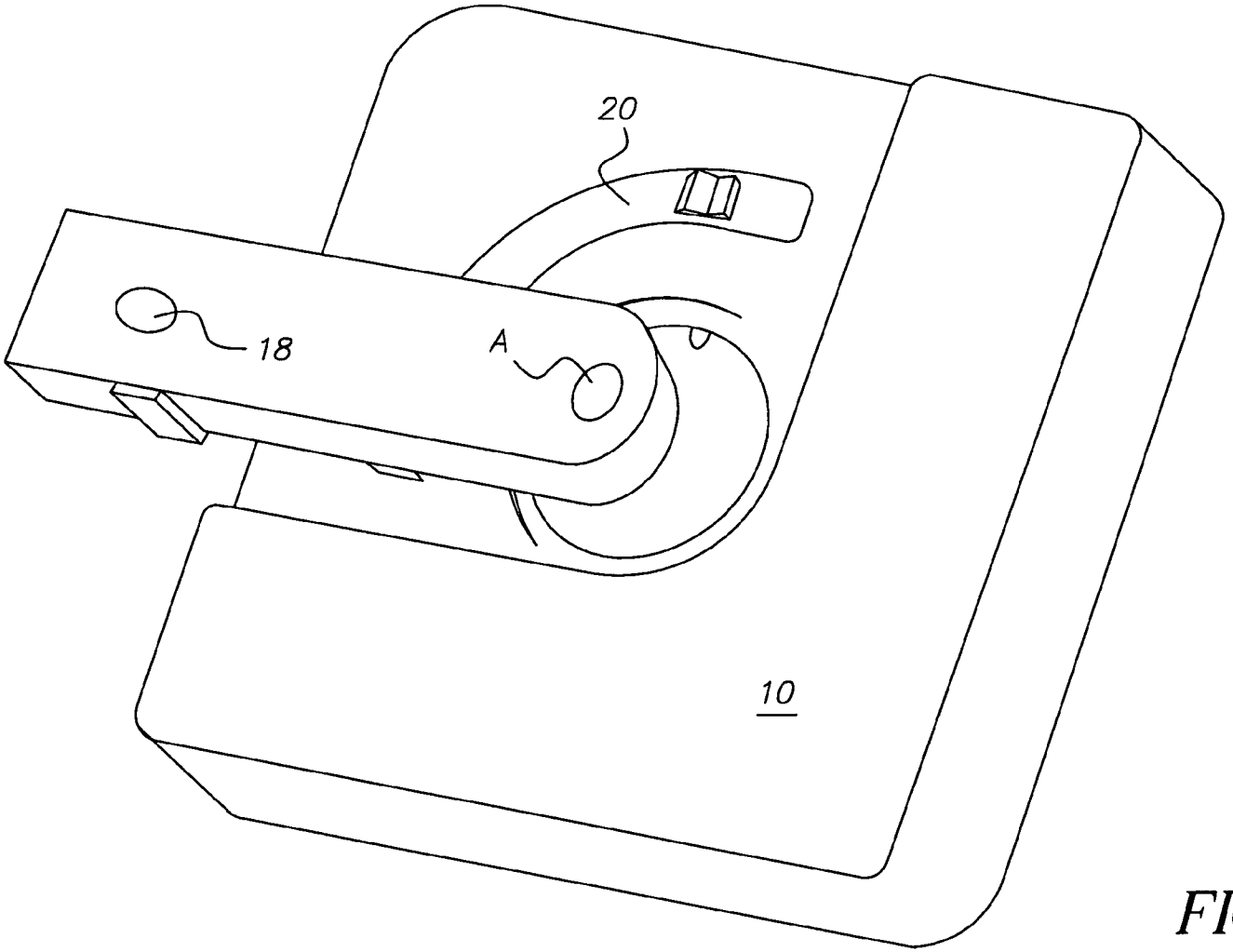
FIG. 3 shows a perspective view of the bucky supported on an arm member and rotating about a cam segment.

FIG. 3 generally shows arm member 18 supporting bucky 10 for rotation about point A. Cam segment 20, disposed on bucky 10, provides for the rotation of bucky 10 about point A.

Figure 4:
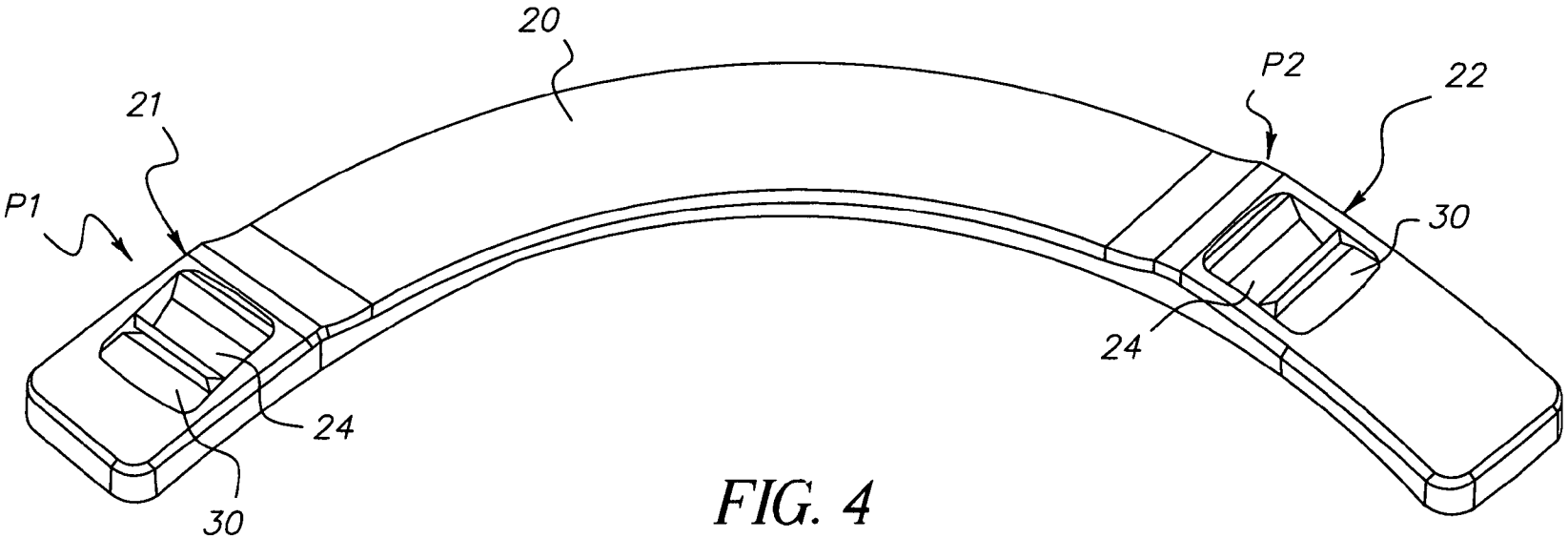
FIG. 4 shows a diagrammatic perspective view of the cam segment of FIG. 3.
Figure 5A:
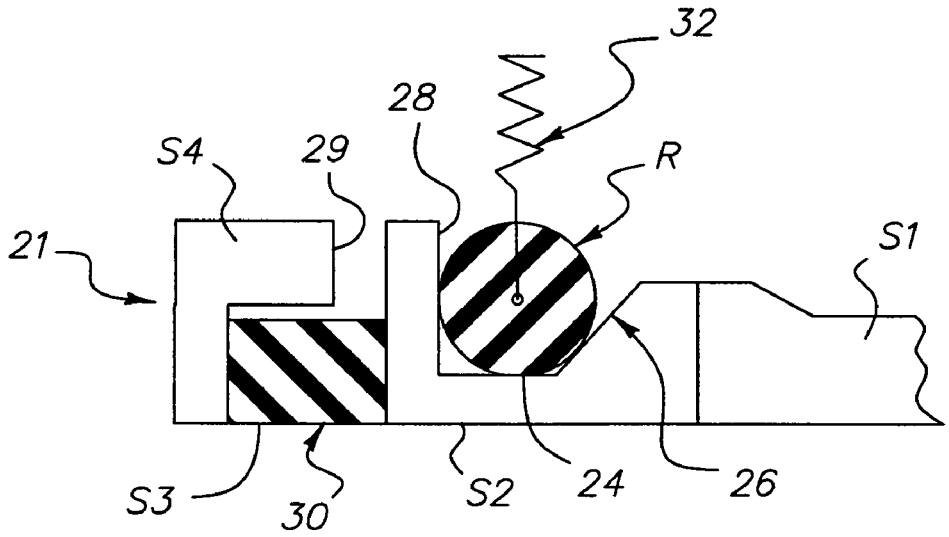
FIG. 5A shows a diagrammatic cross-sectional view of the cam segment of FIG. 4 at a first position P1.
Figure 5B:
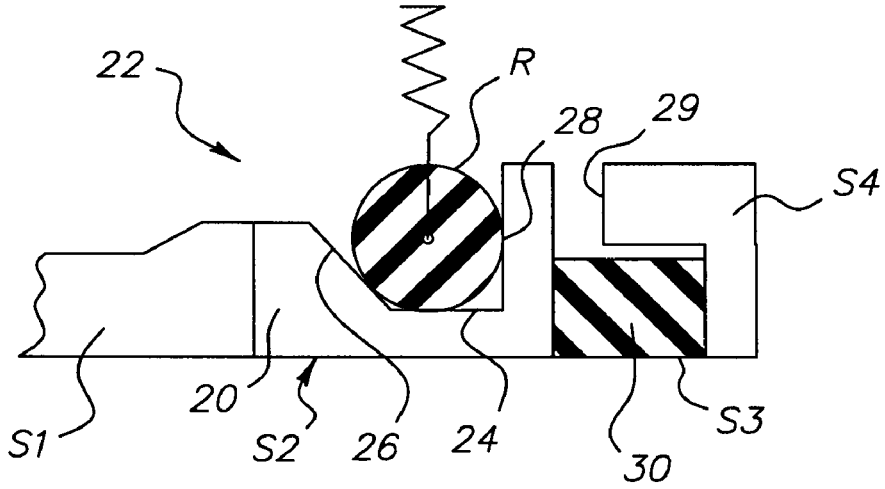
FIG. 5B shows a diagrammatic cross-sectional view of the cam segment of FIG. 4 at a second position P2.

FIGS. 4 and 5A–5B more particularly show cam segment 20. As indicated above, the present invention is being discussed with regard to two positions which are spaced by 90 degrees.

Cam segment 20 includes a base and two detent positions spaced from each other: a first detent position 21 disposed at a first position P1 in the base and a second detent position 22 disposed at a second position P2 in the base. For this particular example, P1 and P2 are spaced at 90 degrees from each other. Position P1 can be associated with a portrait orientation while position P2 can be associated with a landscape orientation. FIG. 5A shows a diagrammatic side view of cam segment 20 at first position P1, while FIG. 5B shows a diagrammatic side view of cam segment 20 at second position P2.

First and second detent positions 21,22 each include four sections: an entry section S1 formed in the base; a resting section S2 which moves relative to the base; an absorption section S3 which moves relative to the base; and a travel limiting section S4 formed in the base to limit travel of resting section S2. Resting section S2 is disposed intermediate entry section S1 and absorption section S3.

Each entry section S1 is part of the base of cam segment 20. Each entry section S1 includes an angled portion to promote smooth motion and entry of roller R into and out of resting section S2.

Each resting section S2 is distinct/separate from the base of cam segment 20, and is mounted relative to the base such that resting section S2 can slide relative to the base of cam segment 20. Each resting section S2 includes a detent insert 24 (which can also be referred to as a groove, channel, and/or cavity) adapted to receive and maintain a roller R. When roller R is received within detent insert 24, bucky 10 is maintained in its position. An angled portion of resting section S2, herein referred to as detent ramp 26, promotes smooth actuation/positioning/motion of roller R into and out of detent insert 24. A substantially vertical portion, herein referred to as detent stop 28, stops roller R within detent 24.

Each travel limiting section S4 includes travel stop 29 to limit the travel of resting section S2 relative to absorption section S3.

Absorption section S3 provides shock absorption for the system as roller R enters and/or exits resting section S2. Shock absorption is accomplished through compression of an energy absorbing member. As such, absorption section S3 includes at least one shock absorption member 30, for example, a rubber insert. Shock absorption member 30 is disposed intermediate detent stop 28 and cam segment 20 so as to absorb energy which might occur when roller R enters and/or exits resting section S2.

Shock absorption member 30 is under compression (pre-compression) such that resting section S2 is biased toward entry section S1.

Figure 6:
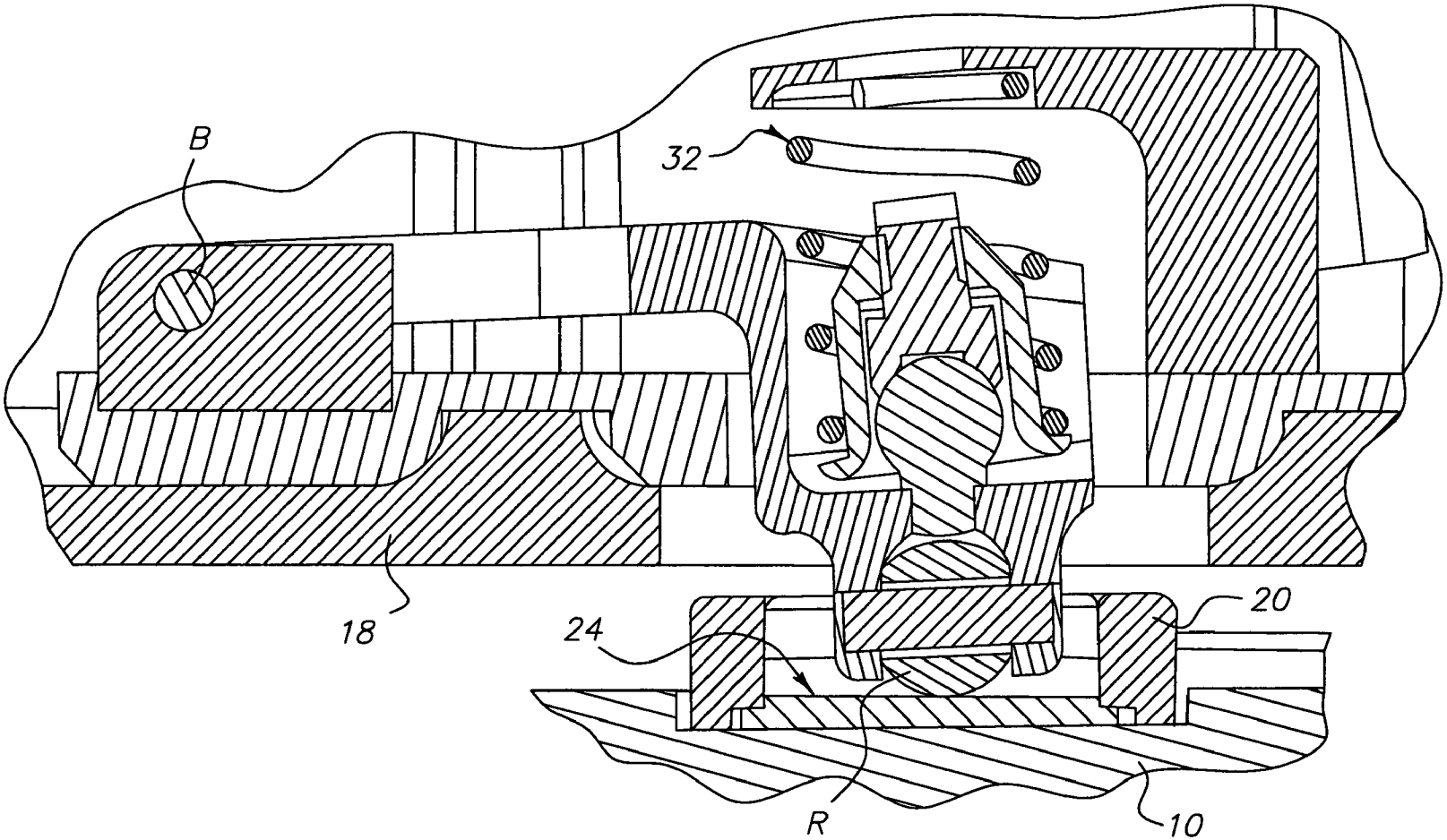
FIG. 6 shows a diagrammatic cross-sectional view of the assembly of the present invention including a roller assembly.

Referring now to FIG. 6, a roller assembly is provided to articulate the roller. The roller assembly is generally comprised of roller R, a means to support roller R, and at least one spring 32 to apply sufficient force normal to the detent surface to bias roller R toward cam segment 20. Those skilled in the art will recognize that other methods/apparatus/configurations can be employed to articulate the roller relative to the cam segment. For Applicant's roller assembly shown in FIG. 6, roller R is mounted to pivot about a point B to allow smooth motion into and out of the detent insert of resting section S2.

Roller R is comprised of a material selected for minimal wear over many cycles. A urethane coated detent roller can be employed.

It may be desirable to indicate, to the modality, the position/orientation of the bucky (e.g., portrait or landscape). Mechanical switches/levers/members (on the bucky and/or cam segment) can interact with electrical switches on the bucky to signal, to the modality, the position/orientation of the bucky.

Operation of the assembly of the present invention is now described with reference to FIGS. 1–6 and FIGS. 7A–7D.

Figure 7A:
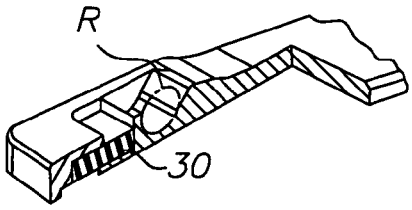
FIGS. 7A–7D show a diagrammatic perspective and side views of the cam segment to illustrate the interaction of the roller and the cam segment as the roller is received within the detent.
Figure 7B:
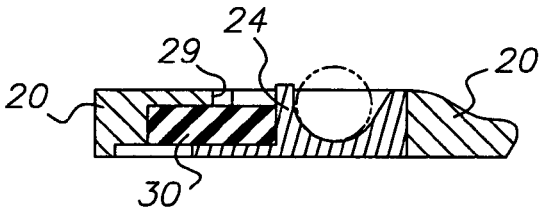

Initially, roller R is disposed within resting section S2 of one of the positions whereby bucky 10 is secure/maintained in that position. For this particular discussion, roller R is disposed within resting section S2 of first position P1. Since shock absorption member 30 is under compression (pre-compression), resting section S2 is biased toward entry section S1, such as shown in FIGS. 7A and 7B.

The present invention is directed to an assembly which provides for the manual actuation (not motor, gravity or spring load driven, no requirement to active/press a button to cause actuation) rotational movement of a member between a first and second position. Therefore, to effect a positional/rotational change, the user/operator pushes/rotates bucky 10 in a rotational manner about axis A.

The user/operator exerts a force on bucky 10 to move roller R along detent ramp 26 in a (rotational) direction along cam segment 20 toward second position P2. A pre-determined force is needed to allow roller R to move along detent ramp 26 to entry section S1 and thereby release roller R from detent insert 24 of resting section S2. Once the user/operator exerts this pre-determined amount of force, roller R moves out of resting section S2, past entry section S1, and along cam segment 20 toward second position P2.

For Applicant's particular application, Applicant has a preferred release force of approximately 25 pounds±3 pounds.

Figure 7C:
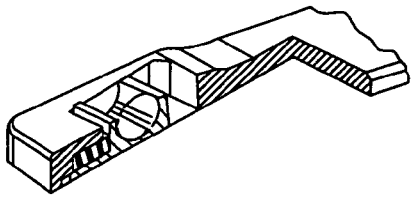
Figure 7D:
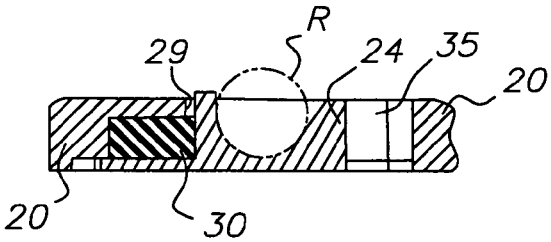
Figure 8:
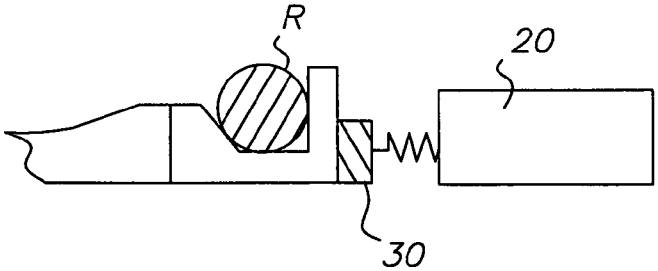
FIG. 8 shows a diagrammatic side view illustrating an alternate configuration for the shock absorption member.

At second position P2, initially pre-compressed shock absorption member 30 biases resting section S2 toward entry section S1. As roller R moves past entry section S1 and begins moving along detent ramp 26 of resting section S2, the inertial forces of bucky 10 cause resting section S2 to compress shock absorption member 30, causing resting section S2 to move away from entry section S2. Refer to FIGS. 7C and 7D, showing a spacing/separation 35 of resting section S2 and entry section S1. As the shock absorption member 30 becomes more compressed, travel stop 29 might abut resting section S2 to limit travel of resting section S2.

Once roller R is within detent insert 24, and the inertial energy is dissipated by shock absorption member 30, shock absorption member 30 becomes less compressed and causes resting section S2 to, again, be biased toward entry section S1 (as shown in FIGS. 7A and 7B).

Shock to the system which occurs during the movement of roller R due to a change in position between P1 and P2 is absorbed by shock absorption member 30.

In another embodiment, shock absorption member 30 is attached to cam segment 20 by means of a spring, which can provide additional travel of resting section S2.

It is noted that the cam segment can be formed directly in the housing of the bucky such that the cam segment is integral with the bucky.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

PARTS LIST

10 bucky
12 radiographic stand
18 bucky support arm member
20 cam segment
21 first detent position
22 second detent position
24 detent insert/groove/channel/cavity
26 detent ramp
28 detent stop
29 travel stop
30 shock absorption member; rubber insert
32 spring
35 spacing/separation of resting section

What is claimed is:

1. An apparatus for rotating a bucky about an axis, the apparatus comprising:

a base member stationarily disposed on the bucky and having a first and second rotational position to position the bucky;

a first and second absorption member mounted to the base member;

a first assembly disposed at the first position and slidably mounted relative to the base member, the first assembly having a first detent adapted to receive a roller when the bucky is in the first position, the first assembly being disposed intermediate the first absorption member and base member, the first absorption member biasing the first assembly toward the second position; and a second assembly disposed at the second position and slidably mounted relative to the base member, the second assembly having a second detent adapted to receive the roller when the bucky is in the second position, the second assembly being disposed intermediate the second absorption member and base member, the second absorption member biasing the second assembly toward the first position.

2. The apparatus of claim 1, wherein the first assembly comprises an angled portion disposed adjacent the first detent such that the roller moves along the angled portion when the roller is received into and removed from the first detent.

3. The apparatus of claim 1, wherein the base member includes a mechanical stop which abuts the first assembly when the first absorption member is compressed to a pre-determined amount.

4. The apparatus of claim 1, wherein the first absorption member is further compressed when the roller enters the first detent of the first assembly.

5. The apparatus of claim 1, wherein the first assembly moves relative to the base member when the roller enters the first detent of the first assembly.

* * * * *